United States Patent [19]

Kyte

[11] 4,359,076

[45] Nov. 16, 1982

[54] ADJUSTABLE BASKET FILLER, BLANK AND METHOD OF MAKING

[76] Inventor: Garrett J. Kyte, SRI 32A Smith Island, Ewell, Md. 21824

[21] Appl. No.: 207,874

[22] Filed: Nov. 18, 1980

[51] Int. Cl.[3] ..... B65B 5/00; B65D 5/44; B65D 25/20

[52] U.S. Cl. ..... 141/391; 53/390; 220/4 A; 220/76; 220/287; 229/21; 493/269

[58] Field of Search ..... 217/3 R, 3 BC, 3 CB; 220/470, 4 A, 76, 287; 53/384, 390; 141/390, 391; 229/21; 493/303, 307, 269

[56] References Cited

U.S. PATENT DOCUMENTS

| | | | |
|---|---|---|---|
| 429,169 | 6/1890 | Dursy | 220/4 A |
| 1,879,950 | 9/1932 | Read, Jr. | 229/21 X |
| 2,262,758 | 11/1941 | Erne | 220/76 |
| 2,377,548 | 6/1945 | Giordano | 220/4 A X |
| 2,686,608 | 8/1954 | Rock | 220/4 A |
| 2,878,956 | 3/1959 | Chovanes | 220/4 A |
| 2,904,208 | 9/1959 | Woolfolk | 220/4 A |
| 3,983,914 | 10/1976 | Benson | 53/390 X |

*Primary Examiner*—Allan N. Shoap
*Attorney, Agent, or Firm*—John W. Huckert

[57] ABSTRACT

A basket filler, blank for making same, and a method of making same include an elongated body member formed of flexible and yet resilient material, shaped and preformed so that the body member has arcuate edges along the long sides thereof, one end of the body member being provided with a plurality of spaced stepped shoulders with each stepped shoulder being provided with one or more slots, the other end of the elongated member provided with projections for engagement during assembly of them with the stepped shoulder slots, and tabs provided by slits cut into the body member from the longer arcuate edge of the body member. During the process of assembly of the basket filler blank, the desired diameter of the filler is ascertained from measurement of a basket with which the filler is to be used, and then the appropriate stepped shoulder selected for receiving the projections through the slots thereof. The projections then are bent over to secure the basket filler blank in the desired finished adjusted position. The support tabs are bent outwardly at a desired angle for supportive engagement of the filler upon a basket. A number of embodiments of the angles and shape of the support tabs are disclosed.

6 Claims, 10 Drawing Figures

ADJUSTABLE BASKET FILLER, BLANK AND METHOD OF MAKING

BACKGROUND OF THE INVENTION

1. Field of the Invention

This invention relates generally to devices for use with various sized baskets while being filled with live marine life for the purpose of preventing the escape thereof.

2. Description of the Prior Art

A common problem with known type basket fillers for use in filling with live marine life a basket having handles extending outwardly therefrom is that the filler is of a predetermined size and only fits a given sized basket.

Another common problem of known type basket filler devices is that they are completely formed and assembled during the manufacture thereof and thus are relatively bulky and fairly expensive to ship, as well as requiring a fair amount of storage space when not in use.

Another problem of known type devices is that they're not adjustable for different sizes of baskets to be filled, nor can they be stored and shipped in a substantially flat, nonassembled form.

The present invention is a substantial improvement over applicant's U.S. Pat. No. 4,191,226, granted on Mar. 4, 1980. This patent has a number of the disadvantages listed above, and the present invention is a substantial improvement thereover.

SUMMARY OF THE INVENTION

An object of the present invention is to provide an adjustable basket filler which can be used with many different sizes of baskets.

Another object of this invention is to provide a preshaped blank for use in making an adjustable basket filler which permits the unassembled basket filler to be shipped flat and in relatively compact state at minimum cost.

A further object of this invention is to provide a blank for making an adjustable basket filler for use with different sized baskets for filling same with live marine life in order to prevent the escape thereof, and which is provided with extending tab members which support the basket filler upon the basket for which it has been sized.

A still further object of this invention is to provide various embodiments for the above mentioned supporting tabs which will permit the basket filler to be substantially self-centering when mounted upon a basket to be filled. Or said tabs are arranged to be shortened or provided with bent over tip portions for the purpose of decreasing the chance of injury to someone passing closely by a basket being filled as provided with a basket filler of subject invention.

A further object of this invention is in the method of making the blank for the adjustable basket filler of subject invention.

One of the very important advantages of the present invention is the fact that the filler is adjustable for different sizes of baskets to be filled with live marine life. At the dock, and wherever else the filler may be used, it is often desirable that it be usable with baskets of varying sizes. The basket filler of this invention is so adjustable that on the site the size can be quickly changed if desired from one basket size to another.

Another very important feature of the present invention is in the fact that the blank used for making the adjustable basket filler is preformed and precut ready for quick assembly to a completed filler, and yet prior to assembly relatively flat and compact, and thus easily stored, shipped, distributed, and even sold in the unassembled form.

A method of making the blank of the present invention is also encompassed by this invention and is an important part thereof.

Further important features of the present invention are in the adjustable projecting tabs which are used for supporting the assembled basket filler upon a basket to be loaded. In several embodiments of the disclosed invention, the tabs diverge outwardly at a substantial angle so that when the filler by means of the tabs rest upon the upper edge of a basket top opening, the filler itself will be substantially self-centering. Another embodiment provides for the tabs to project substantially straight outwardly from the main body of the filler, i.e., substantially perpendicular thereto, so that the filler can be very quickly placed into position and just as quickly removed from the top of a basket being filled upon completion of the filling thereof. Also in this version, the tabs may be shortened so that the ends thereof only project slightly beyond the upper basket opening edge thus minimizing any chance of injury to a close passerby.

A still further embodiment, the end tips of the projecting members, rather than being shortened as just described, may be bent downwardly to provide additional securement from sidewise movement across the upper basket opening, and to then increase the securement of the filler thereupon.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
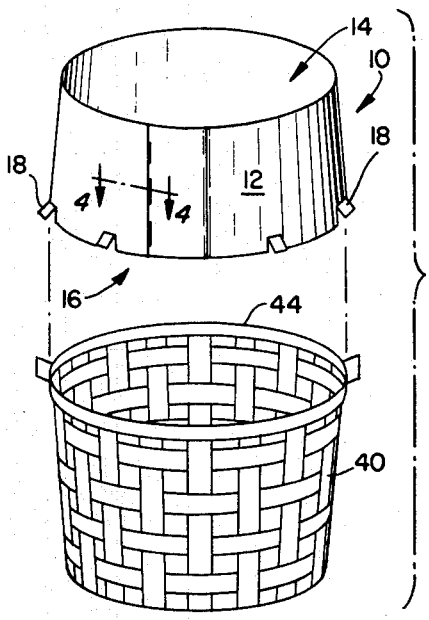
FIG. 1 is a perspective view of an assembled basket filler of this invention as in use.

Referring to FIG. 1 of the drawings, reference numeral 10 indicates in general the assembled adjustable basket filler of this invention as ready for use with a bushel basket 40. The basket filler has a body member 12 provided with projecting tabs 18 for supporting same upon the surrounding edge 44 of the top opening of the basket. Normally, the upper opening 14 of the basket filler is slightly smaller in size than the lower opening 16. Thus, the assembled filler has a shape of a truncated cone.

Figure 3:
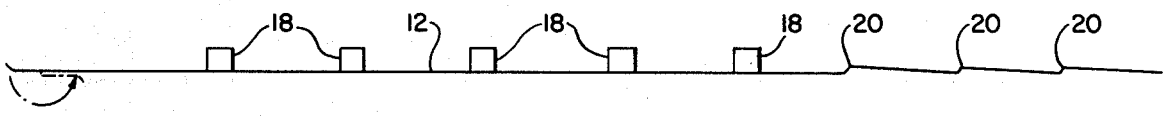
FIG. 3 is a top plan view taken generally along lines 3—3 of FIG. 2.
Figure 2:
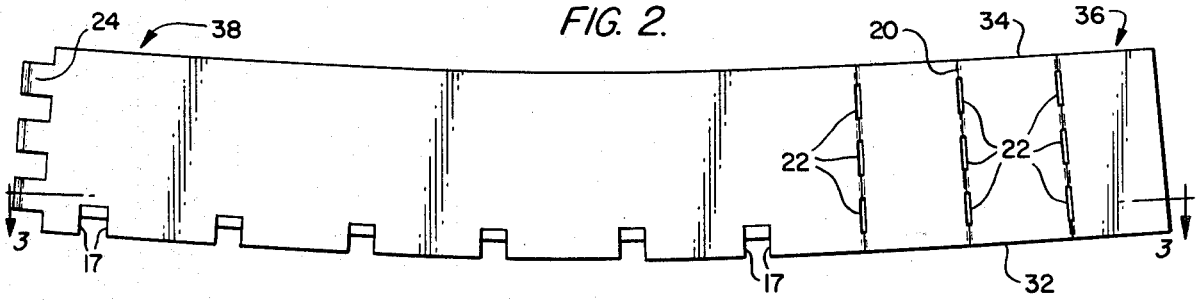
FIG. 2 is a back elevational view of a preshaped blank prior to assembly of the basket filler.

Looking at FIGS. 2 and 3 of the drawing, the preshaped blank for making the basket filler of the present invention is shown. The body 12 is a relatively long substantially rectangular member which has arcuate side edges 32 and 34. The edge 32 which becomes the lower edge of the basket filler is of convex shape, while the edge 34 which becomes the upper edge of the filler is of concave shape. The lower edge 32 is provided with a plurality of spaced slits 17 extending inwardly one-fifth to one-third of the overall width of the member for the purpose of providing support tabs 18.

Figure 4:
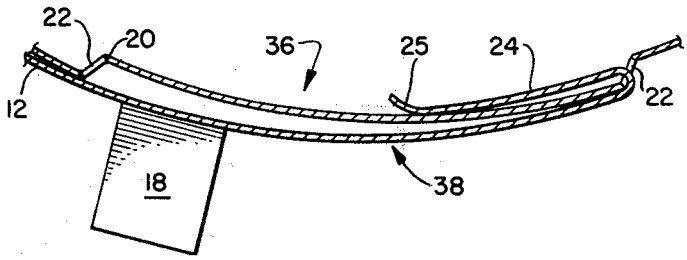
FIG. 4 is a cross-sectional view taken generally along lines 4—4 of FIG. 1.

One end 36 of the blank is provided with a plurality of stepped shoulder portions 20 which have provided therethrough spaced slots 22. Preferably three slots are provided in each stepped shoulder, but as few as one or as many as six or seven may be provided. The other end 38 of the body member 12 is provided with extending projections 24 which are the same in number as the slots 22 already described. The purpose of the projections 24 is for complementary engagement with the slots 22 in order to assemble the blank into the completed basket filler. As can be seen in FIGS. 1 and 4, the projections 24 are bent back upon the body member part way and then the ends of the projections 24 inserted through slots 22, and then the projections bent completely back into engagement with the inner side of the end 36 of the body member. While three stepped shoulders 20 are shown, of course more than this number may be provided to increase the adjustability feature of the subject invention. As also clearly seen in FIG. 4, the very tip end of the projection 24 may be slightly bent as at 25 to facilitate engagement or disengagement of the projections through the slots 22 as the basket filler is changed in size after the first initial assembly thereof. This is an additional feature of subject invention in that the first size adjustment is not fixed, but after original use of the basket filler, can be later changed in size for use with smaller or larger baskets.

Figure 5:
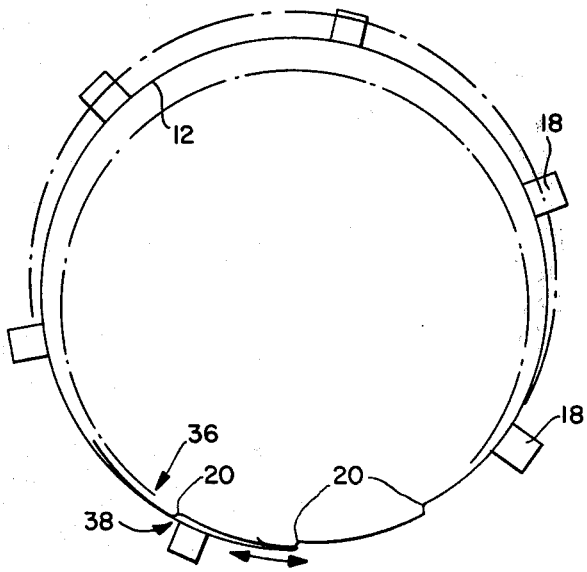
FIG. 5 is a diagramatic sketch from the top showing the adjustable feature of subject invention.

As seen in FIG. 5, merely by disengaging the projections 24 from their complementary slots 22, the end 38 of the body member can be moved to another stepped shoulder portion 20 and the projections once again engaged with a smaller or larger overall size of the basket filler. A smaller size is depicted by the inner dot-dash lines of FIG. 5, with the larger size being depicted by the outer dot-dash lines of this figure.

Figure 6:
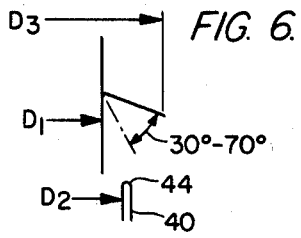
FIG. 6 is a fragmentary portion showing a support tab adjusted at an angle within the preferred range of 30° to 70°.

Further very important features of the present invention are provided by the support tabs 18. These tabs, as created by the slits 17, are normally bent outwardly as shown in FIGS. 3 and 4 away from the inner side of the body member. In FIG. 6 the preferred embodiment of the present invention is shown. In this figure the preferred range of tab projecting angle relative to the body member of 30° to 70° is shown. With this range of 30° to 70°, a self-centering feature is effected. That is, when the basket filler is placed upon the basket, the upper edge of the basket mates with the angled tabs and because of the 30° to 70° angle, the basket filler automatically positions itself with the central portion of the filler in alignment with the basket opening. As seen in FIG. 6, the inner diameter of the lower edge of the basket filler is indicated by $D_1$, the inner diameter of the opening of the basket is indicated by $D_2$, while the diameter of the outer tips of the tabs 18 are indicated by $D_3$. Thus, with this arrangement as long as the diameter $D_2$ of the basket opening falls between the diameters $D_1$ and $D_3$ the self-centering feature will be effected. If, of course the diameter $D_2$ of the basket is less than the diameter $D_1$, then the basket filler must be made smaller by adjusting same, while conversely if the diameter $D_2$ is larger than diameter $D_3$, then the basket filler must be adjusted to be made larger. Again, once the sizing of the filler has been made, the self-centering feature again will be effected.

Figure 7:
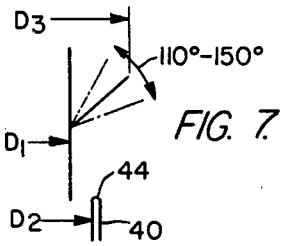
FIG. 7 is another fragmentary portion similar to FIG. 6 but showing another embodiment with the tab angle range of 110° to 150°.

While the embodiment of FIG. 6 is the preferred one, another embodiment as shown in FIG. 7 may be used. In this embodiment of FIG. 7, the tabs are bent so as to be at an angle of 110° to 150° relative to the plane of the body and with respect to the bottom opening edge. This arrangement has the same 40° total range as the first embodiment, but the tabs are of course pointing toward the upper edge of the basket filler rather than the lower edge. This embodiment will again have a self-centering effect, but the support and securement of the filler to the basket is not quite as good as with the version of FIG. 6.

Figure 8:
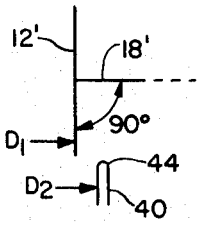
FIG. 8 is a fragmentary portion showing another embodiment with the support tabs substantially at 90° and shortened in length.

FIG. 8 shows another embodiment wherein the tabs 18' are bent outwardly at substantially 90° to the plane of the body member 12'. In this embodiment preferably the outer tips of the tabs 18' are removed or cut off. If the diameter $D_1$ of the basket filler is just slightly smaller than the diameter $D_2$ of the basket, the tabs 18' need extend only a very small amount in order to perform the supporting function. By shortening the tabs 18', the tips do not project outwardly much beyond the basket and filler combination, and therefore a normal hazard of a sharp tab edge injuring a person passing closely by is substantially eliminated.

Of course, the amount of the tip removed can be just a fraction of the overall tab 18', or almost all of it depending upon the variety of sizes of the basket filler as adjusted and the basket with which it is intended to be used.

Figure 9:
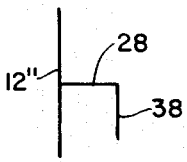
FIG. 9 is a still further embodiment showing a modification of the FIG. 8 embodiment.

FIG. 9 shows a still further embodiment wherein the tabs 28 are bent outwardly at substantially 90° to the body member as in the embodiment of FIG. 8, but instead of removing the tip portion, the tip portion 38 is bent downwardly in the form of a depending flange. This depending flange or tip 38 then will function to secure the basket filler on the basket and prevent substantial sidewise movement thereof on the basket. Because, the outer tips of the tabs 28 are bent downwardly, they also will perform a safety function in that the sharp outer edge of the tip no longer projects radially outwardly and thus cannot easily come into contact with a passerby.

The blank as shown in FIGS. 2 and 3, can be preformed and preshaped at the factory out of flexible sheet metal, plastic material, flexible fiberboard or cardboard type of material, and the like. In fact any material which can be cut and slotted and shaped, and also curved into shape without cracking or deformation, can be used.

During the process of making the blank of subject invention, a roll of material approximately the desired width can be used, the material unwound so as to have a flat piece of the desired length, and then the desired piece severed from the main supply roll. Thereafter, the arcuate side edges 32 and 34 can be cut or punched into the elongated body member and thereafter the shoulders 20 with slots therein formed. Then, the projections 24 can be formed in the other end. Thereafter the plurality of spaced slits 17 are cut into the member from the edge 32 to provide the support tabs 18. Once this forming of the body member has been completed, the member can then be stored relatively easily, packaged, shipped and distributed in any desired manner with minimum cost and with the greatest degree of compactness.

Only when it is desired to assemble the adjustable basket filler, is it necessary to bend the tabs 18 to the desired angle, and also to bend the projections 24 for engagement with the slots 22.

Of course, if it is desirable to completely assemble the basket filler at the factory or at the original point of sale, this can easily be accomplished from the preformed and preshaped blanks.

Another very important feature of the present invention is in the fact that the angles for the support tabs 18 as shown in FIGS. 6 and 7 may be effected any time after the original filler blank has been formed. In fact, even while in use, and while changing sizes of baskets, the angles of the tabs may be changed.

Similarly with the embodiments of FIGS. 8 and 9, these embodiments can be effected following the embodiment of FIG. 6 and/or FIG. 7.

Figure 10:
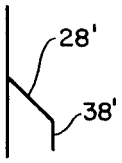
FIG. 10 is still another embodiment.

The embodiment of FIG. 10 is a combination of the embodiments of FIGS. 6 and 9. In this last embodiment, the desirable self centering features of the FIG. 6 are present, while adding the securement and safety features of the FIG. 9 embodiment.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A blank for making a size adjustable marine life basket filler comprising:

an elongated member;

one end of said member having a series of closely spaced stepped shoulders formed therein each traversely to the length thereof;

at least one slot provided in each stepped shoulder;

the other end of said member having at least one projection extending therefrom for complementary engagement with a shoulder slot for the purpose of securing the respective ends of said elongated member together during assembly of the overall basket filler;

and one elongated side edge provided with slits extending from the outer edge inwardly thereof for providing support tabs for supportive engagement with a basket opening edge after assembly of the overall bsket filler.

2. The device of claim 1, wherein said elongated edges of said elongated member are arcuately shaped, and the ends thereof are at a slight angle so that the blank upon assembly will form a truncated cone with one open end being smaller than the other open end.

3. The device as in claim 2, wherein said slits as provided for the purpose of forming supportive tabs, are cut into said blank substantially perpendicular to the longest elongated arcuate shaped edge thereof which forms the larger open end of the device.

4. The device of claim 3, wherein during assembly of the blank into an overall basket filler, said tabs are bent outwardly at a desired angle to the body member to provide a supportive feature for the basket filler relative to a basket with which it is to be used.

5. The device as in claim 4, wherein said tabs are bent at such an angle as to provide a self-centering feature for the basket filler relative to a basket with which it is to be used.

6. A method of making an adjustable basket filler blank for later assembly into a completed overall basket filler for use in filling a basket with live marine life comprising:

providing an elongated body member of relatively flexible and yet resilient material;

forming said elongated body member with arcuate edges along the length thereof;

forming a plurality of stepped shoulders at one end of said elongated member;

providing at least two slots in each of said plurality of stepped shoulders;

providing at least two complementary projections on the other end of said elongated body member;

and providing a plurality of slits along one arcuate elongated edge of said body member to form self-centering supportive tabs which when bent outwardly from the plane of the body member provide self-centering supportive structure for the assembled basket filler..

* * * * *